US005839147A

United States Patent [19]

Chia-Yi et al.

[11] Patent Number: 5,839,147

[45] Date of Patent: Nov. 24, 1998

[54] MOPPING DEVICE WITH REPLACEABLE CLEANING MEMBER

[76] Inventors: Hsieh Chia-Yi, No. 357-2, Chung Hua Road, Wu-Chi Chen; Chen Chin-Chu, No. 23, Alley 33, Lane 24, Sec 3, Chung Yang Road, Lung-Ching Hsiang, both of Taichung Hsien, Taiwan

[21] Appl. No.: 994,947

[22] Filed: Dec. 19, 1997

[51] Int. Cl.[6] ..... A47L 13/14; A47L 13/20

[52] U.S. Cl. ..... 15/119.2; 15/147.1; 15/228; 15/231; 15/244.2

[58] Field of Search ..... 15/116.1, 116.2, 15/119.1, 119.2, 147.1, 148, 150, 228, 231–233, 244.1, 244.2

[56] References Cited

U.S. PATENT DOCUMENTS

| | | | |
|---|---|---|---|
| 1,993,571 | 3/1935 | Soderberg | 15/231 |
| 2,438,338 | 3/1948 | Horn | 15/244.2 X |

FOREIGN PATENT DOCUMENTS

| | | | |
|---|---|---|---|
| 463790 | 3/1950 | Canada | 15/119.2 |
| 810360 | 4/1969 | Canada | 15/231 |
| 857036 | 12/1960 | United Kingdom | 15/119.2 |
| 91/16849 | 11/1991 | WIPO | 15/147.1 |

*Primary Examiner*—Mark Spisich
*Attorney, Agent, or Firm*—Bacon & Thomas

[57] ABSTRACT

A mopping device includes a first part and a second part pivotally connected to the first part from which a handle is pivotally disposed. Two connecting members and a torsion spring are respectively pivotally connected between the first and the second part so that the second part is foldable toward the first part. Each of the first part and the second part has at least one clamping member pivotally connected thereto such that a cleaning member is securely disposed to an underside of the first and the second part by being clamped by the two clamping members.

5 Claims, 7 Drawing Sheets

MOPPING DEVICE WITH REPLACEABLE CLEANING MEMBER

BACKGROUND OF THE INVENTION

1. Field of the Invention

The present invention relates to a mopping device and, more particularly, to an improved mopping device for a cleaning member replaceably and compressibly attached thereto.

2. Brief Description of the Prior Art

A conventional mopping device includes a handle and a cleaning member, such as a sponge head, fixed to a frame and transversely connected to a lower end of the handle, a squeezing means disposed to the handle and operably connected to the sponge head for squeezing the sponge head. Another type of mopping device uses a static electricity fabric to be disposed to the frame. The static electricity fabric is detachably connected to the frame by hook-and-loop members and is used to mop a wooden floor to collect dust, hairs or the like. There is yet another type of mopping device which uses a kind of durable fabric having a rough outer surface which removes dirt adhered on the floor. The mopping device having the sponge head occupies a larger space than that occupied by the mopping device having the static electricity fabric, so that there needs a large room to receive these mopping devices because these three mopping devices have different functions which are often utilized.

The present invention intends to provide an improved mopping device which includes two parts pivotally connected together and has a replaceable cleaning member attached to the two parts by four clamping members so as to mitigate and/or obviate the above-mentioned problems.

SUMMARY OF THE INVENTION

In one aspect of the present invention, there is provided a mopping device comprising a first part having a tongue extending from an inner side thereof which has two first and second slots defined therein, and a second part having a recessed portion defined in an upper surface thereof so as to receive the tongue therein. The first part has at least one first lug disposed at an upper surface thereof from which a handle is pivotally connected. The second part has two second recesses defined in an inner side thereof and at least one second lug disposed to the upper surface thereof.

Two connecting members are respectively received in the corresponding pair of the first and the second slots so as to pivotally connect the first part and the second part. The first part has a torsion spring disposed at an underside thereof and the torsion spring has two legs respectively contacting against the first part and the second part so as to maintain the first part and the second part connected to each other along the respective inner sides thereof.

The first part has a clamping member pivotally disposed at the first lug with a link member pivotally connected therebetween, and the second part has a clamping member pivotally disposed at the second lug with a link member pivotally connected therebetween.

It is an object of the present invention to provide a mopping device which has a second part being able to be folded toward the first part.

It is another object of the present invention to provide a mopping device having at least two clamping members to clamp a cleaning member to an underside of the first and the second part.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
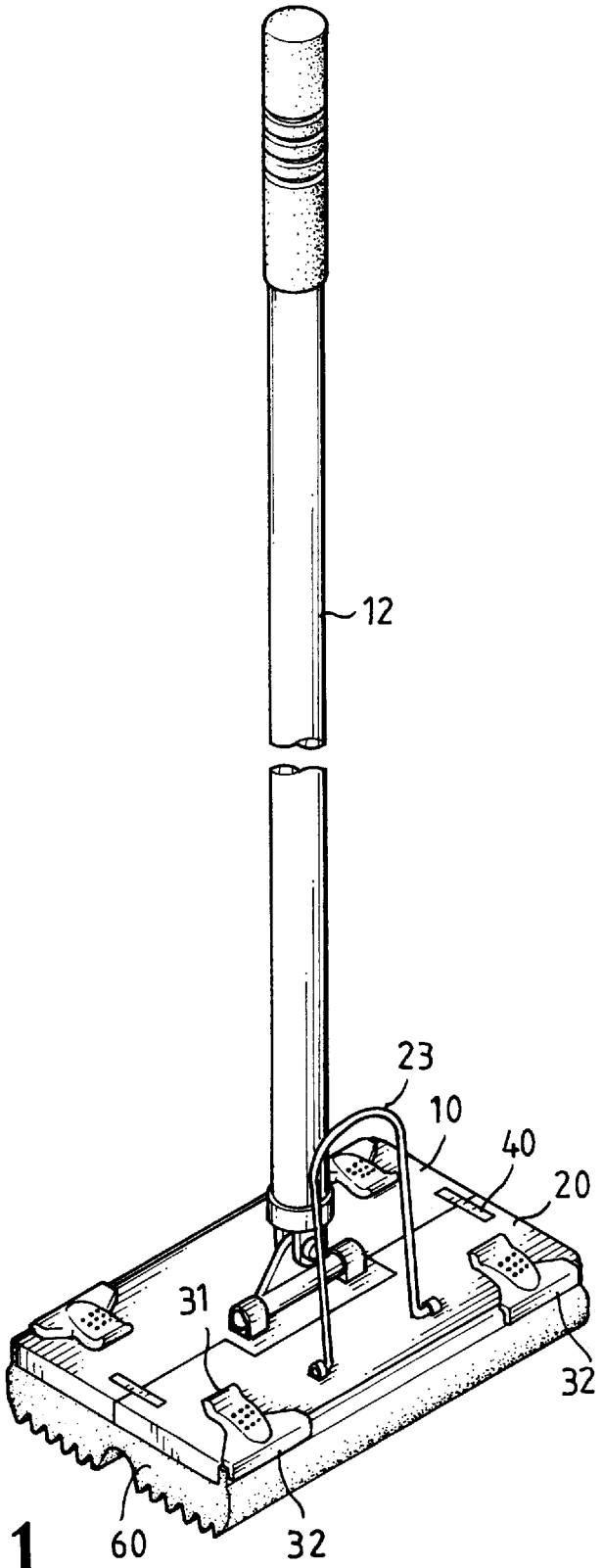
FIG. 1 is a perspective view of a mopping device in accordance with the present invention.
Figure 2:
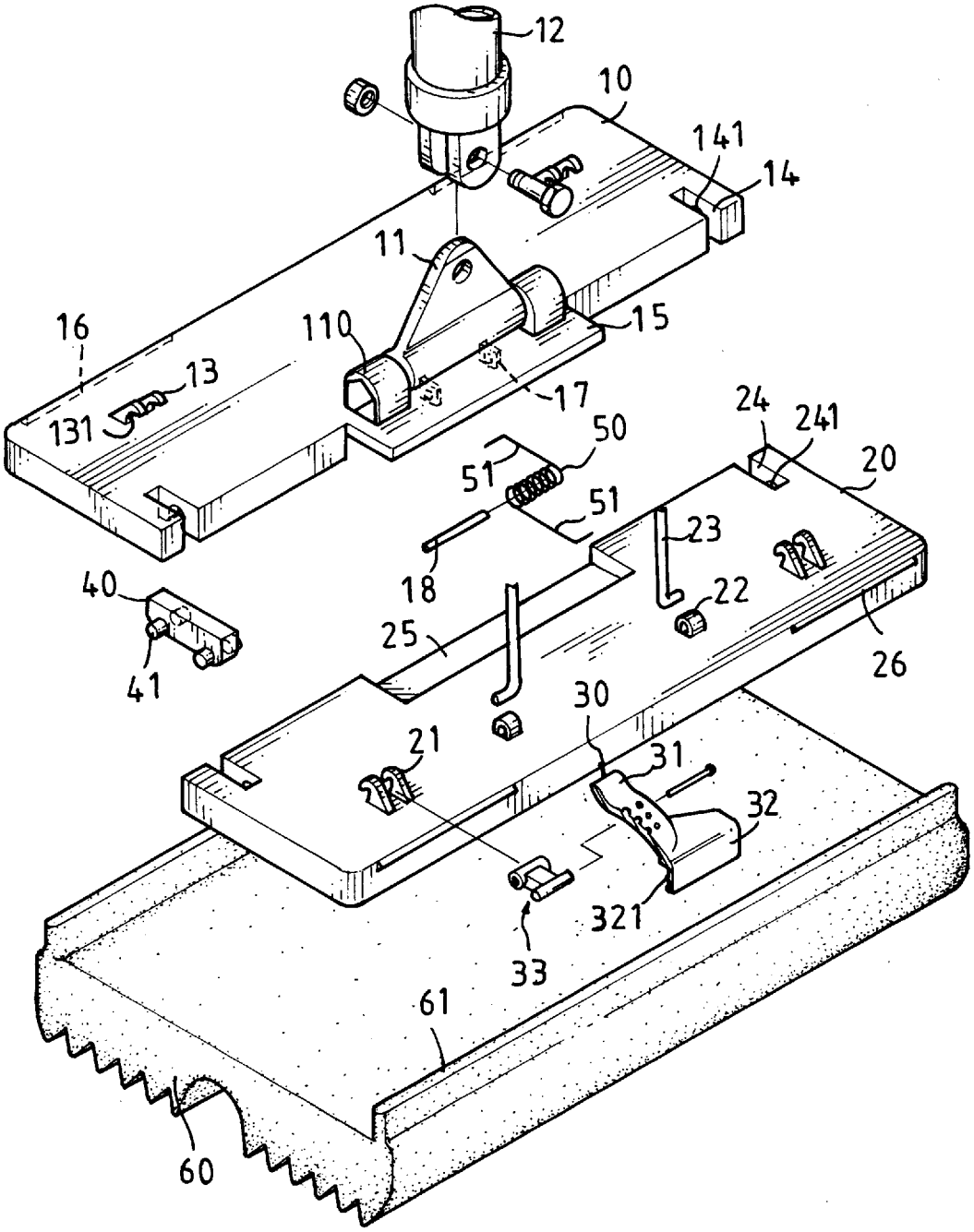
FIG. 2 is a exploded perspective view of a sponge head and the mopping device in accordance with the present invention.
Figure 3:
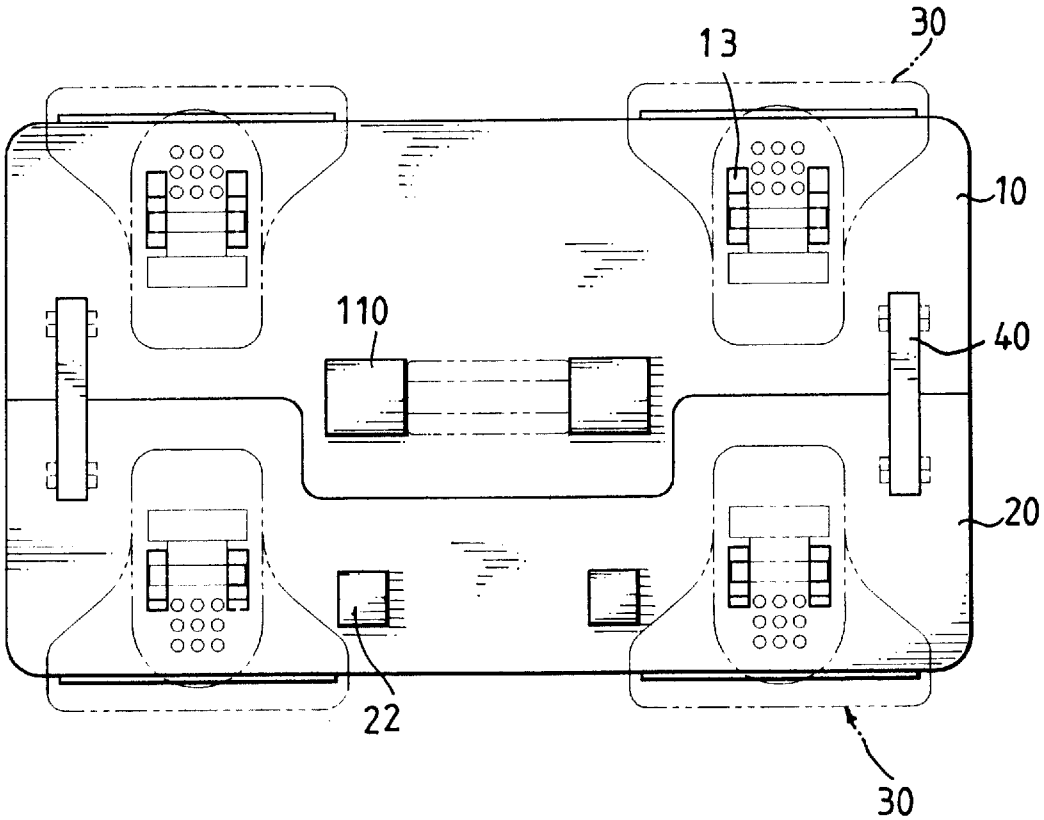
FIG. 3 is a top illustrative view to show the mopping device of the present invention.
Figure 4:
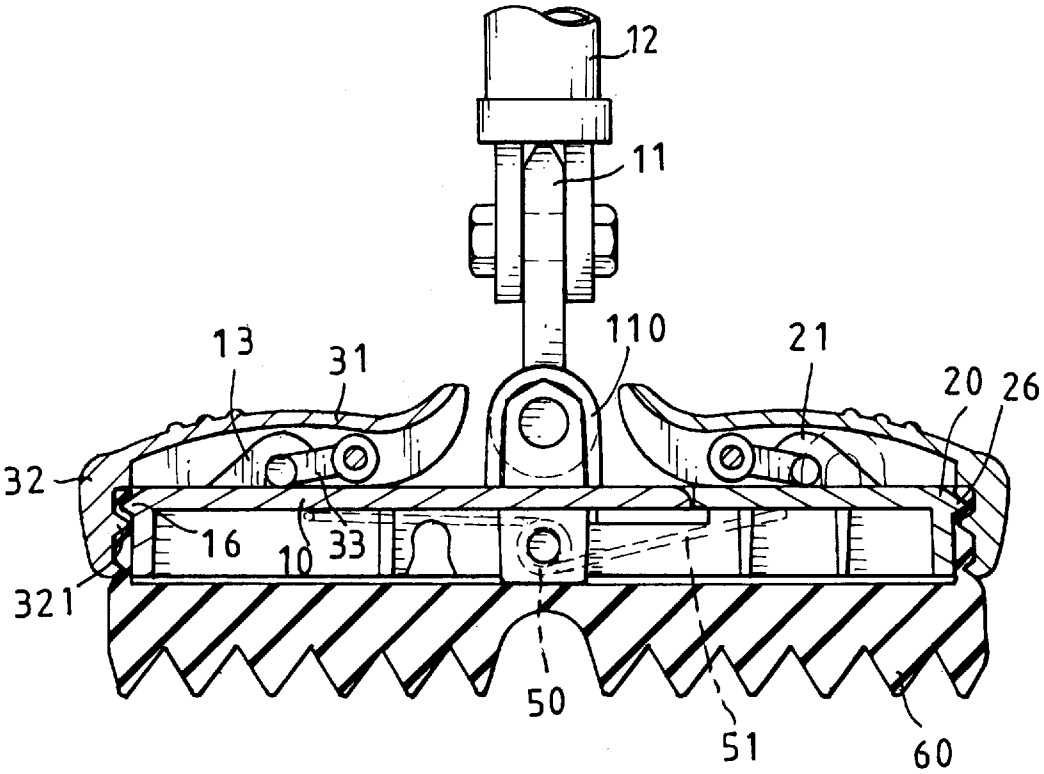
FIG. 4 is a side elevational view, partly in section, of the mopping device of the present invention.

Referring to the drawings and initially to FIGS. 1 through 4, a mopping device in accordance with the present invention generally includes a first part 10 having a tongue 15 extending from an inner side thereof which has two first slots 14 defined therein. Each of two opposite inner sides defining the first slot 14 has two recesses 141 defined therein. Two pairs of first lugs 13 are disposed at an upper surface thereof and each of the first lugs 13 has a notch 131 defined in an underside thereof. Two ring members 110 are disposed at the upper side of the first part 10 and has a base member 11 pivotally connected therebetween so that a handle 12 is fixedly connected thereto. The first part 10 further has two plates 17 disposed at the underside thereof so as to securely receive a pin 18 to which a torsion spring 50 is mounted. The first part 10 has two flanges 16 extending laterally from an outer side thereof.

A second part 20 has a recessed portion 25 defined in an upper surface thereof so as to receive the tongue 15 therein and two second slots 24 defined in an inner side thereof. Each of two inner sides defining the second slot 24 has two recesses 241 defined therein. Two pairs of second lugs 21 are disposed to the upper surface of the second part 20. Two ring members 22 are disposed at the upper surface of the second part 20 so as to pivotally receive an inverted U-shaped operation bar 23 therebetween. The second part 20 has two flanges 26 extending laterally from an outer side thereof.

Figure 6:
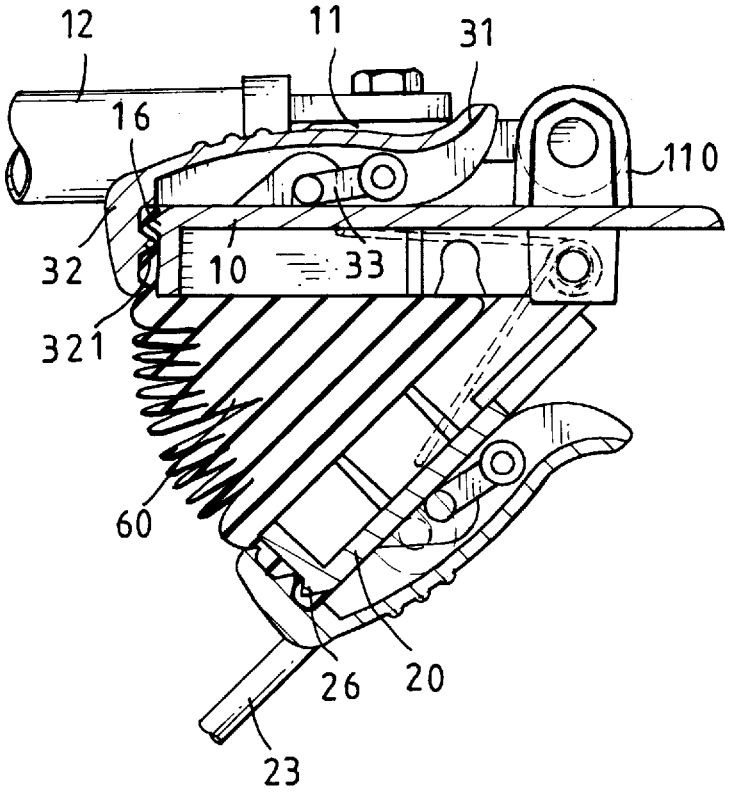
FIG. 6 is a side elevational view, partly in section, showing a second part folded toward a first part of the mopping device to compress the sponge head.

Two connecting members 40 each have two studs 41 extending laterally from two opposite sides thereof so as to be respectively received in the corresponding pair of the first and the second slot 14, 24 with studs 41 received in the recesses 141, 241 so as to pivotally connect the first part 10 and the second part 20. The torsion spring 50 has two legs 51 respectively contacting against the first part 10 and the second part 20 so as to maintain the first part 10 and the second part 20 connected to each other along the respective inner sides thereof such that the second part 20 is able to be folded downwardly toward the first part 10 as shown in FIG. 6.

Two clamping members 30 are respectively pivotally disposed to the two pairs of the first lugs 13 with a link member 33 pivotally connected between the corresponding pair of the first lugs 13 and the first clamping member 30. Each of the clamping members 30 includes a lever portion 31 to which the corresponding link member 33 is connected and a pawl portion 32 extending perpendicularly from the lever portion 31. The link member 33 has one end thereof pivotally received in notches of the first lugs 13 and the other end thereof pivotally connected to the corresponding lever portion 31. The pawl portion 32 has two sharp members 321 extending from an inner side thereof. The second part 20 has the same two clamping members 30 pivotally disposed to the two pairs of second lugs 21 with a link member 33 pivotally connected between each one of the clamping members 30 and the corresponding pair of second lugs 21.

A sponge head 60 has two ribs 61 extending upwardly from two sides of an upper surface thereof so that the sponge head 60 is fixedly attached to an underside of the first part 10 and the second part 20 by clamping the two ribs 61 respectively between the two pawl portions 32 and the respective outer sides of the first and the second part 10, 20. The two sharp members 321 and the flanges 16, 26 provide a secure positioning feature to the ribs 61. Referring to FIG. 6, when pushing the operation bar 23 downwardly the second part 20 can be folded downwardly toward the first part 10 so as to compress the sponge head 60.

Figure 5:
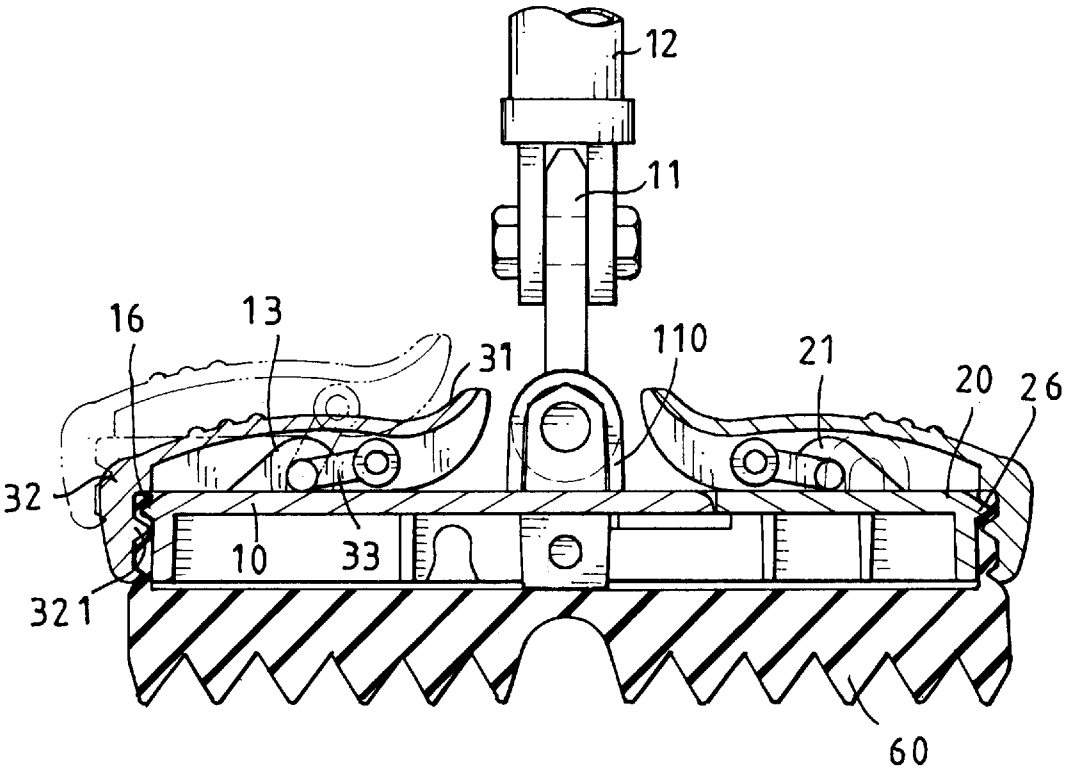
FIG. 5 is a side elevational view, partly in section, of a clamping member disposed at the mopping member and being pulled upwardly.
Figure 7:
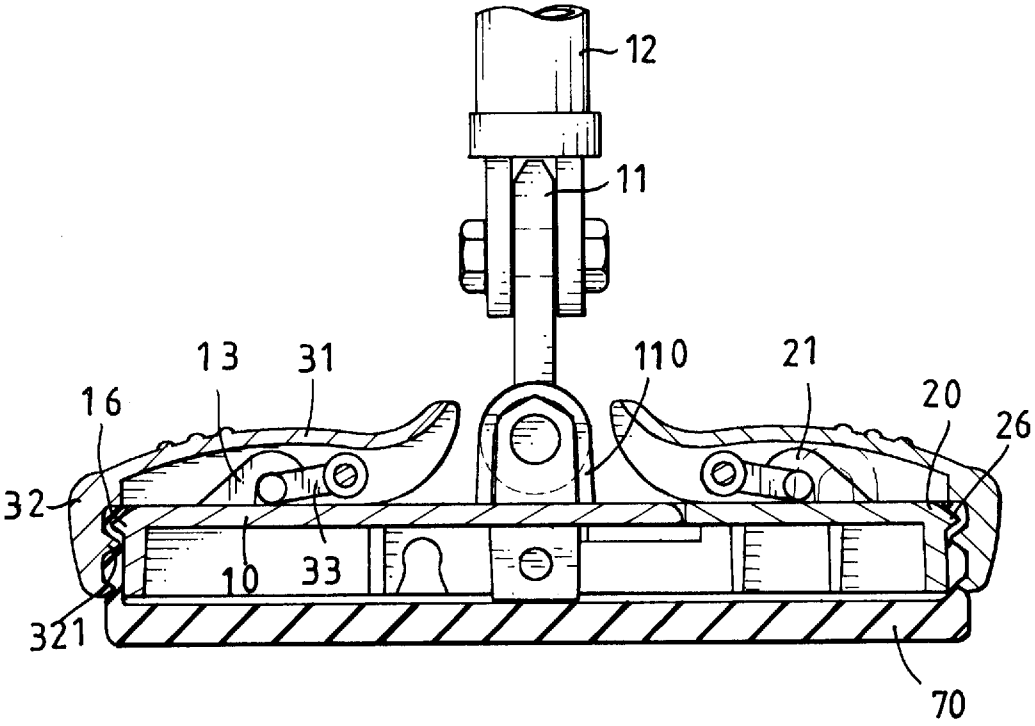
FIG. 7 is a side elevational view, partly in section, of another type of cleaning member attached to the mopping device of the sent invention.

Referring to FIG. 5, when pulling the lever portion 31 of the clamping member 30 upwardly and outwardly, the pawl portion 32 is then disengaged from the first/second part 10/20 to release the clamping status of the rib 61. By this way, referring to FIG. 7, the sponge head 60 can be replaced by another cleaning member such as a static electricity fabric 70.

Although the invention has been explained in relation to its preferred embodiment, it is to be understood that many other possible modifications and variations can be made without departing from the spirit and scope of the invention as hereinafter claimed.

What is claimed is:

1. A mopping device comprising:

a first part having a tongue extending from an inner side thereof which has two first slots defined therein, two first lugs disposed at an upper surface thereof, a handle pivotally connected to said upper surface of said first part;

a second part having a recessed portion defined in an upper surface thereof so as to receive said tongue therein and two second slots defined in an inner side thereof, two second lugs disposed at said upper surface thereof;

two connecting members respectively received in said first slots and said second slots so as to pivotally connect said first part and said second part;

said first part having a torsion spring disposed at an underside thereof, said torsion spring having two legs respectively contacting against said first part and said second part so as to maintain said first part and said second part connected to each other along said respective inner sides thereof, and said first part having a clamping member pivotally disposed at said first lugs with a link member pivotally connected therebetween, said second part having a clamping member pivotally disposed at said second lugs with a link member pivotally connected therebetween, and said clamping members being adapted to releasably secure a cleaning member.

2. The mopping device as claimed in claim 1 wherein each of said clamping members includes a lever portion to which said link member is connected, a pawl portion extending perpendicularly from said lever portion and at least one sharp member extending from an inner side thereof.

3. The mopping device as claimed in claim 1 wherein each of said connecting members has two studs extending laterally from two opposite sides thereof, each of said first and said second slots having two recesses defined in each of two opposite inner sides defining said first/second slots so as to receive said studs.

4. The mopping device as claimed in claim 1 wherein each of said first part and said second part has at least one flange extending from an outer side thereof.

5. The mopping device as claimed in claim 1 wherein said second part has an operation bar pivotally connected to said upper surface thereof.

* * * * *